US005438492A

United States Patent [19]

Collins et al.

[11] Patent Number: 5,438,492

[45] Date of Patent: Aug. 1, 1995

[54] END RELEASE SEAT BELT BUCKLE

[75] Inventors: Cecil A. Collins, Shelby Township; Tammy M. Butchko, Warren; Kurt W. Schulz, Harper Woods; Gerald F. Durbin, Algonac, all of Mich.

[73] Assignee: AlliedSignal Inc., Morristown, N.J.

[21] Appl. No.: 146,219

[22] Filed: Nov. 1, 1993

Related U.S. Application Data

[63] Continuation-in-part of Ser. No. 38,661, Mar. 26, 1993, abandoned.

[51] Int. Cl.[6] ..... A44B 11/25; B60Q 3/00

[52] U.S. Cl. ..... 362/108; 362/83.3; 362/800; 24/633; 24/641

[58] Field of Search ..... 362/800, 253, 83.3, 362/108; 24/633, 640, 641

[56] References Cited

U.S. PATENT DOCUMENTS

| | | | |
|---|---|---|---|
| 4,365,285 | 12/1982 | Brundidge | 362/108 |
| 4,928,366 | 5/1990 | Ballet | 24/641 |
| 4,933,818 | 6/1990 | Eckmann | 362/83.3 |
| 5,132,880 | 7/1992 | Kawamura | 362/253 |
| 5,181,773 | 1/1993 | Colvin | 362/83.3 |

FOREIGN PATENT DOCUMENTS

| | | | |
|---|---|---|---|
| 0122238 | 10/1984 | European Pat. Off. | 24/633 |
| 0141734 | 5/1985 | European Pat. Off. | 24/633 |
| 4849126 | 7/1973 | Japan . | |
| 5476818 | 11/1977 | Japan . | |
| 55-30367 | 8/1980 | Japan . | |
| 57-22803 | 5/1982 | Japan . | |
| 6342809 | 11/1983 | Japan . | |
| 61-36469 | 2/1986 | Japan . | |
| 55-30366 | 8/1989 | Japan . | |
| 1406864 | 9/1975 | United Kingdom . | |

*Primary Examiner*—Ira S. Lazarus
*Assistant Examiner*—Sara Sachie Raab
*Attorney, Agent, or Firm*—Harness, Dickey & Pierce

[57] ABSTRACT

An end release type belt buckle for releasably latching a tongue plate of a safety belt system in a latched position. The belt buckle has a base, a release mechanism and an actuator supported for sliding movement on the base. The base has a stationary latch portion adapted to releasably lock the tongue plate in the latched position. The actuator includes a first surface for urging the tongue plate into the latched position, a second surface for retaining the tongue plate in the latched position, and a third surface for actuating the release mechanism to urge the tongue plate from the latched position into a released position. In addition, the end release belt buckle includes an illumination device affixed to the actuator for illuminating selected portions thereof, and an electrically conductive coupling arrangement for maintaining an electrical circuit during sliding movement of the actuator.

13 Claims, 8 Drawing Sheets

END RELEASE SEAT BELT BUCKLE

CROSS REFERENCE TO RELATED APPLICATION

This application is a continuation-in-part of U.S. application Ser. No. 08/038,661, filed Mar. 26, 1993 now abandoned.

BACKGROUND OF THE INVENTION

The present invention relates generally to vehicular seat belt restraint systems and, more particularly, to an end release type seat belt buckle.

Modernly, virtually all motor vehicles are equipped with some type of passenger restraint system for physically restraining the seat occupant when the vehicle is subjected to high rates of deceleration which may occur, for example, during heavy braking or a collision. As is known, the most common passenger restraint system is a seat belt system having at least one of a lap belt and a shoulder belt, or a combination thereof, that can be withdrawn from a retractor device for releasably latching a tongue plate to an anchored belt buckle.

Conventional belt buckles may be generally classified in two distinct categories, namely, "central release" type buckles and "end release" type buckles. As is known, central release belt buckles have a centrally located push button that must be depressed in opposition to a spring-biased latch mechanism for releasing the tongue plate from latched engagement therewith. Alternatively, end release type belt buckles are commonly provided with a spring-biased release button that must be longitudinally displaced for pivoting a locking pawl from a locked position to a released position for releasing the tongue plate. While end release belt buckles are considered to provide enhanced convenience, they are generally complex mechanisms which are often relatively thick and bulky and are difficult and costly to manufacture and assemble.

Conventional belt buckles may also be provided with an illumination mechanism for illuminating portions thereof. Such illuminated belt buckles allow the occupant to quickly locate the buckle such that the tongue plate can be readily latched or released. Most commonly, the illumination mechanism includes fiber optic strands that extend from a light source remotely disposed within the buckle, conventional light bulbs or light emitting diodes that are disposed adjacent to those portions of the belt buckle to be illuminated. While these types of illumination mechanisms are generally satisfactory for this intended purpose, they are often dim and do not provide a steady source of light to the belt buckle.

In view of the foregoing, the need exists to provide an end release belt buckle having a substantially simplified structure, which is reliable in operation, and yet can be easily manufactured and assembled. It would also be desirable to provide such an end release buckle with an illumination mechanism that sufficiently illuminates selected portions of the release button with a steady stream of light.

SUMMARY OF THE INVENTION

Accordingly, the present invention is directed to an improved end release type belt buckle that is operable for releasably latching a tongue plate of a safety belt restraint system. The end release belt buckle of the present invention includes a base having a stationary latch portion which is adapted to lockingly engage the tongue plate for establishing a locked condition, thereby resisting release of tongue plate from the belt buckle. The belt buckle includes release means for releasing the tongue plate from the locked condition, and a spring-biased actuator supported for longitudinal movement on the base and which includes means for selectively actuating the release means. As a related object, the spring-biased actuator further includes means for urging the tongue plate into locked engagement with the latch portion upon insertion of the tongue plate into the belt buckle, and means for retaining tongue plate in the locked condition.

The present invention is further directed to incorporating an illumination mechanism into the end release belt buckle. More particularly, the illumination mechanism includes an illuminating device retained on the spring-biased actuator and a dynamic electrical circuit that permits the spring-biased actuator, and the illumination device retained thereon, to move longitudinally without losing electrical contact between the illumination device and a remote power supply.

These and other various advantages and features of the present invention will become apparent from the following written description when taken in conjunction with the drawings and appended claims.

DETAILED DESCRIPTION OF THE PREFERRED EMBODIMENT

Figure 1:
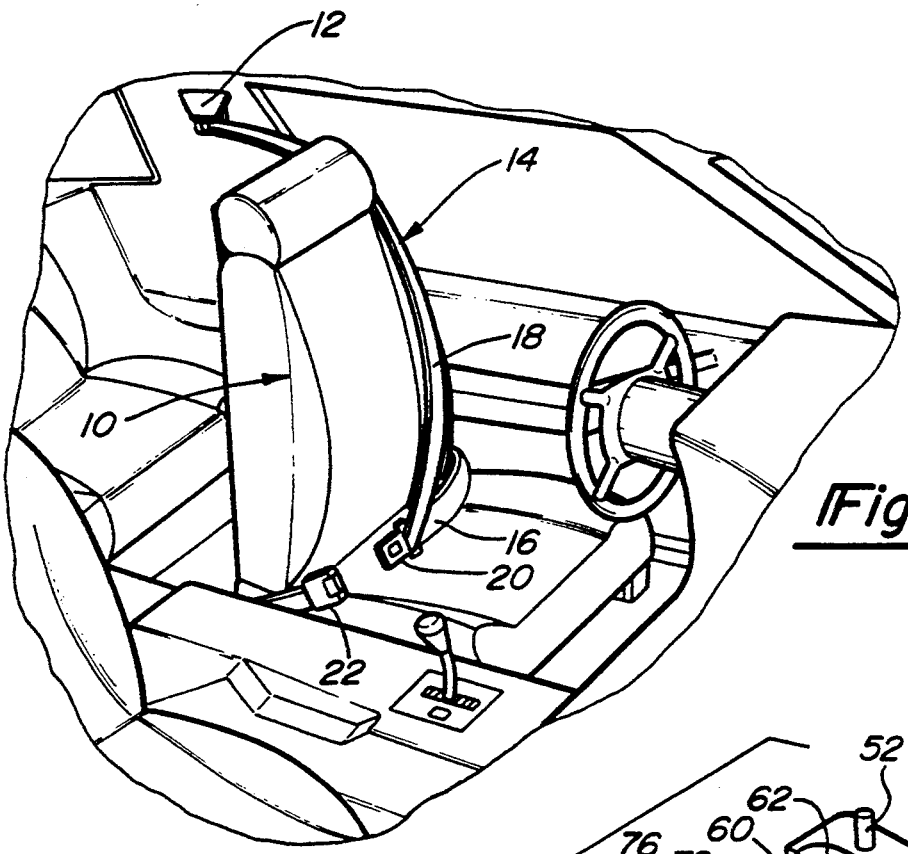
FIG. 1 is a partial interior view of a motor vehicle showing the improved end release belt buckle of the present invention operably associated with an exemplary safety belt restraint system.

With reference to FIG. 1, a portion of the interior of an exemplary motor vehicle is shown to include a seat 10 and a safety belt restraint system having a retractor assembly 12 mounted on a vertical pillar of the motor vehicle in a conventional manner. A safety or "seat" belt 14 includes a lap belt 16 and a shoulder belt 18 which is shown projecting from retractor assembly 12 so as to extend over the shoulder and across the chest of a seat occupant. A tongue plate 20 is retained on shoulder belt 18 and lap belt 16 for fastening to a buckle member 22. Once fastened, seat belt 14 physically restrains the seat occupant within seat 10. In accordance with each of the preferred embodiments of the present invention, buckle member 22 is an "end release" type belt buckle assembly which incorporates various novel features and structure to be described hereinafter with greater specificity.

Figure 2:
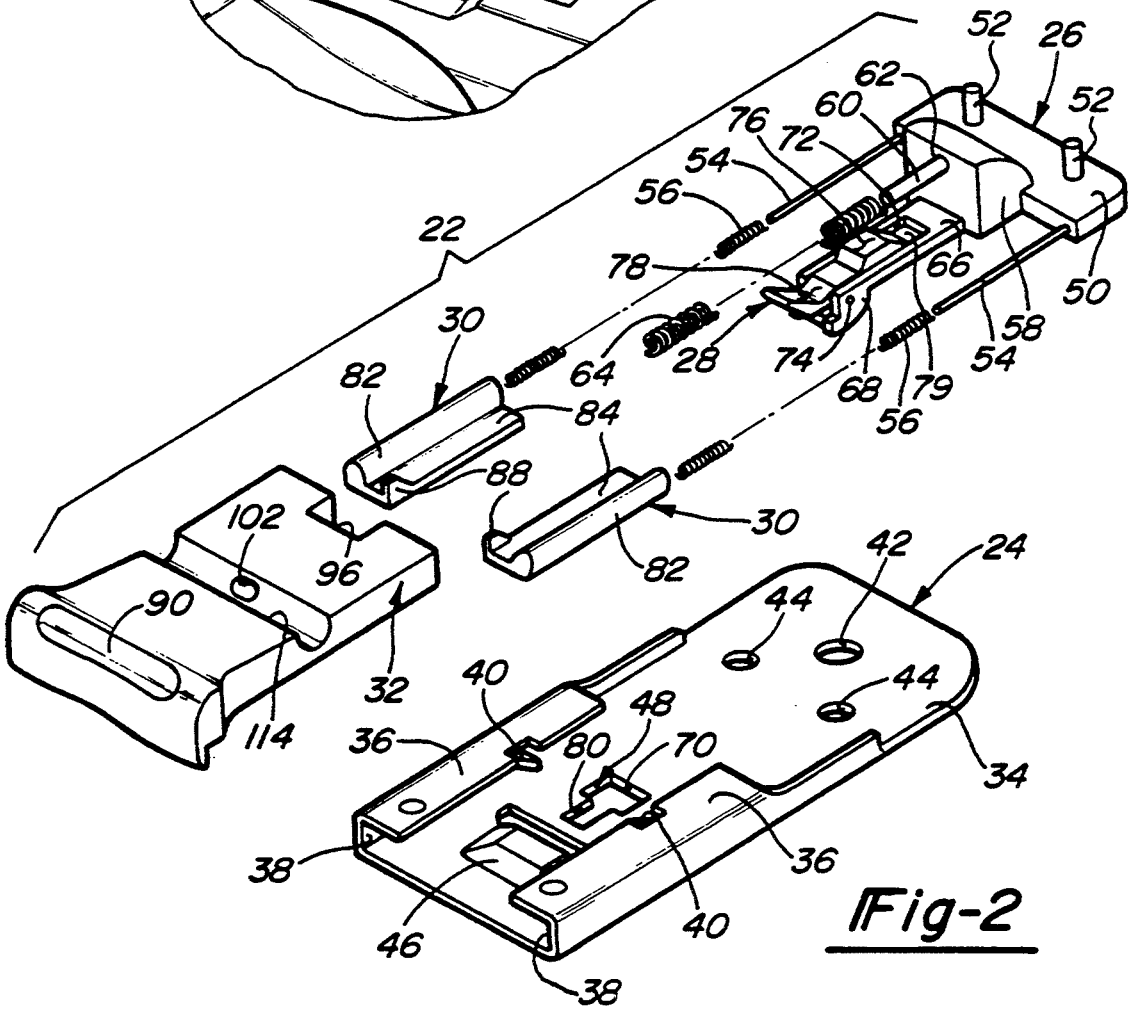
FIG. 2 is an exploded perspective view of the end release belt buckle according to a preferred embodiment of the present invention.
Figure 3:
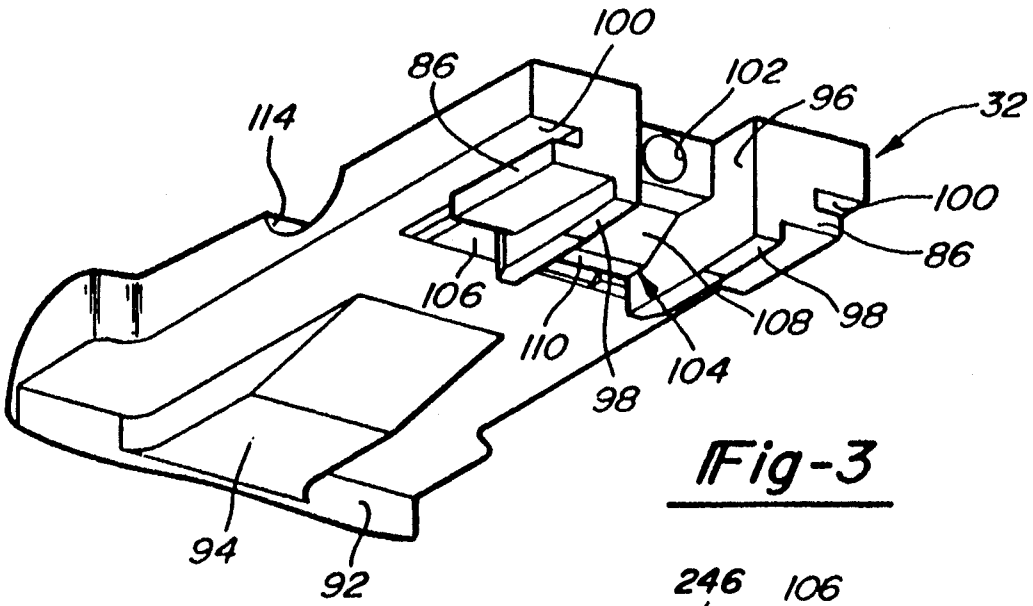
FIG. 3 is a bottom perspective view of the movable actuator member shown in FIG. 1.

With particular reference to FIGS. 2 and 3 of the drawings, the various components associated with end release type belt buckle 22 are shown. However, for purposes of clarity, a protective housing assembly 23 (FIG. 4) which encloses the components has been deleted. In general, belt buckle 22 is an assembly of various components and sub-assemblies which include a base 24, a support block 26 adapted for direct mounting on base 24, and a rocker arm 28 supported for pivotable movement on support block 26. In addition, belt buckle 22 also includes a pair of spring-biased ejector arms 30 and a spring-biased actuator member 32.

Figure 4:
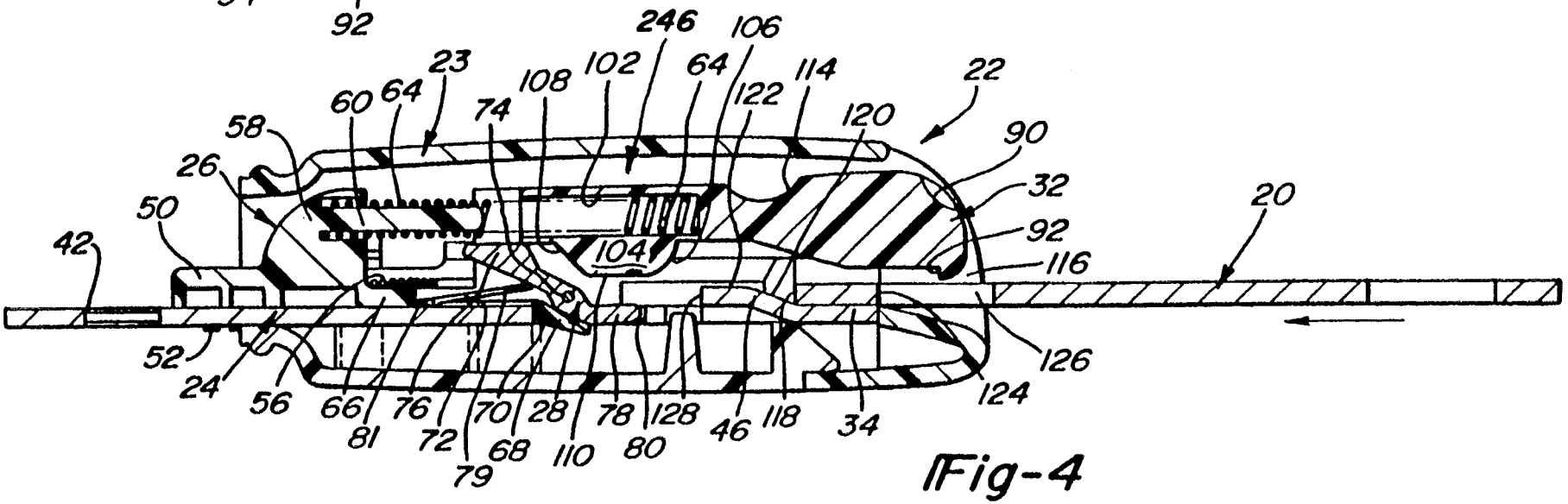
FIGS. 4 through 11 are cross-sectional views of the belt buckle showing a sequence of operations for latching and subsequently releasing a tongue plate.

From the construction shown, base 24 is a rigid structural component formed to include a plate segment 34 and a pair of orthogonal flange segments 36 which extend inwardly along opposite lateral sides of plate segment 34. As such, each flange segment 36 defines an elongated longitudinal guide channel 38 and has a downwardly extending stop projection 40 formed thereon. Plate segment 34 is also formed to include an anchor mounting aperture 42, a pair of support block mounting apertures 44, a raised latch portion 46 and a generally T-shaped access aperture 48. Support block 26 is shown to include a lateral support segment 50 having locating pins 52 formed on its underside surface which are adapted to be inserted (i.e., "snapped") into mounting apertures 44 for fixedly securing support block 26 on plate segment 34 of base 24 (as shown in FIG. 4). In addition, a pair of laterally-spaced spring posts 54 extend forwardly from a front face of lateral support segment 50 for retaining and supporting a first end of elongated ejector springs 56 thereon. Support block 26 also includes a raised backstop segment 58 having a spring post 60 projecting out of a counterbore 62 and on which a first end of an elongated return spring 64 is retained. Furthermore, an extension segment 66 projects from backstop segment 58 and terminates in a downwardly stepped lug 68 which is adapted to be retained within a rear cut-out portion 70 of T-shaped access aperture 48. Extension segment 66 has a shallow channel 72 formed therein with rocker arm 28 mounted on a pivot pin 74 at the distal end of channel 72 for pivotable movement with respect thereto. More particularly, a rear lever portion 76 of rocker arm 28 is retained within channel 72 while a forward lifter portion 78 of rocker arm 28 extends from lug 68 and is adapted to be disposed for pivotable movement within a front portion 80 of T-shaped access aperture 48. To provide means for normally biasing forward lifter portion 78 of rocker arm 28 to extend into front portion 80 of T-shaped access aperture 48, a cantilevered beam 79 extends from backstop segment 58 within shallow channel 72 of extension segment 66 and has a distal end that is adapted to act on an underside surface of rear lever portion 76. In addition, a transverse flange or rib 81 (FIG. 4) is integrally formed on the underside surface of beam 79 in close proximity to backstop segment 58. Upon installation of support block 26 onto base 24, rib 81 engages plate segment 34 for forcibly urging the distal end of beam 79 in an upward direction displaced from channel 72 and in engagement with lever portion 76 of rocker arm 28. Such a biasing arrangement is desirable in that it inhibits the propagation of noise (i.e., "rattling") of rocker arm 28 within belt buckle 22. Thus, installation of locating pins 52 into mounting apertures 44 and retention of stepped lug 68 within cut-out portion 70 of access aperture 48 is operable for positively locating rocker arm 28 relative to base 24.

With continued reference to FIGS. 2 and 3, ejector arms 30 are shown to be substantially mirror-image components each having a raised lug segment 82 adapted for sliding translational movement within its respective guide channel 38. Each ejector arm 30 also has a lower planar segment 84 which provides a sliding bearing surface upon which outwardly extending wings 86, formed on opposite lateral sides of actuator member 32, are supported for sliding movement. In addition, an upwardly extending fin 88 is formed on the inner forward edge of each planar segment 84. Furthermore, an elongated bore (not shown) is formed in the rearward portion of each raised lug segment 82 which is adapted to retain the opposite end of its respective ejector spring 56 therein. Thus, ejector arms 30 are normally biased by ejector spring 56 away from support block 26.

Actuator member 32 is a manually-operable button release which is shown to include a pressure surface, such as a finger pad 90, a downwardly extending front edge stop 92 and a central reinforcing rib 94 formed on its underside surface. The rear portion of actuator member 32 defines a recessed segment 96 having its lateral edges defined by downwardly extending rails 98. Rails 98 are adapted to engage plate segment 34 for supporting actuator member 32 for sliding movement relative to base 24. In addition, wings 86 extend outwardly from rails 98 and define guide slots 1 00 within which the inwardly bent portions of orthogonal flange segments 36 on base 24 are retained. Thus, actuator member 32 is supported for sliding movement relative to base 24 in a manner that is independent of sliding movement of ejector arms 30. In addition, a bore 102 is formed centrally within recessed segment 96 of actuator member 32 and is adapted to support and retain the opposite end of return spring 64 therein. Thus, actuator member 32 is also normally biased in a direction away from support block 26. A retainer block 104 is integrally formed on the underside of actuator member 32 between rails 98 and includes a front cam surface 106, a rear cam surface 108 and an intermediate surface 110 formed therebetween. As will be detailed, the profile of retainer block 104 is such that front cam surface 106 is adapted to assist in latching tongue plate 20 within belt buckle 22, intermediate surface 110 is adapted to retain tongue plate 20 in a latched condition, and rear cam surface 108 is adapted to act on rear lever portion 76 of rocker arm 28 for releasing tongue plate. The above-noted operative features associated with retainer block 104 are all predicated on the position of actuator member 32 with respect to latch portion 46.

To assemble end release belt buckle 22, ejector arms 30 are slid into their respective guide channels 38 of base 24. Ejector arms 30 are prevented from sliding out of the front of guide channels 38 by bumper stops 112 which are aligned to engage a front face of raised lug segments 82. Thereafter, actuator member 32 is assembled onto base 24 by placing the front edges of wing members 86 below the rear edges of flange segments 36 with front edge stop 92 resting on the upper surface of flange segment 36, and then sliding actuator member 32 forward until front edge stop 92 can be snapped down in front of the front edge of base 24. To assist in such assembly, a lateral channel 114 is formed in the upper surface of actuator member 32 for allowing actuator member 32 to resiliently flex, thereby allowing each wing member 86 to slide within its guide channel 38 above planar segment 84 of ejector arm 30 while front edge stop 92 slides along the top surface of flange segments 36. Once assembled, actuator member 32 is allowed to slide on base 24 between a forward limit position defined by the leading edges of wing members 86 engaging stop projections 40, and a rearward limit position defined by front edge stop 92 engaging the front edge of base 24. In addition, ejector arms 30 are thereafter prevented from sliding out of the rear end of guide channels 38 due to fins 88 abutting wings 86 on actuator member 32.

Further assembly is accomplished by pivotally mounting rocker arm 28 to extension segment 66 of support block 26. One end of each ejector spring 56 is then placed over one of spring posts 54, while one end of return spring 64 is placed over central spring post 60 and slid into counterbore 62. The resulting support block subassembly is then mounted on base 24 by placing the rear face surface of stepped lug 68 against the rear edge of cut-out portion 70 of T-shaped access opening 48 and inserting locating pins 52 into support block mounting apertures 44. Upon such assembly, the front end of each ejector spring 56 is disposed with the bore formed in raised lug 82 of its respective ejector arm 30 while the front end of return spring 64 is retained within bore 102 in actuator member 32, whereby actuator member 32 and ejector arms 30 are forcibly urged to their forward limit positions. As noted, such assembly also causes cantilevered beam 79 to be forcibly urged upwardly into contact with the underside surface of rear lever portion 76 for biasing rocker arm 28 relative to access opening 48. Thereafter, housing assembly 23, shown to include otherwise conventional upper and lower housing sections, is secured in a known manner to surround the above-noted components. Finally, belt buckle 22 is anchored to the vehicle structure by a fastener (not shown) which is disposed within anchor mounting aperture 42.

Figure 5:
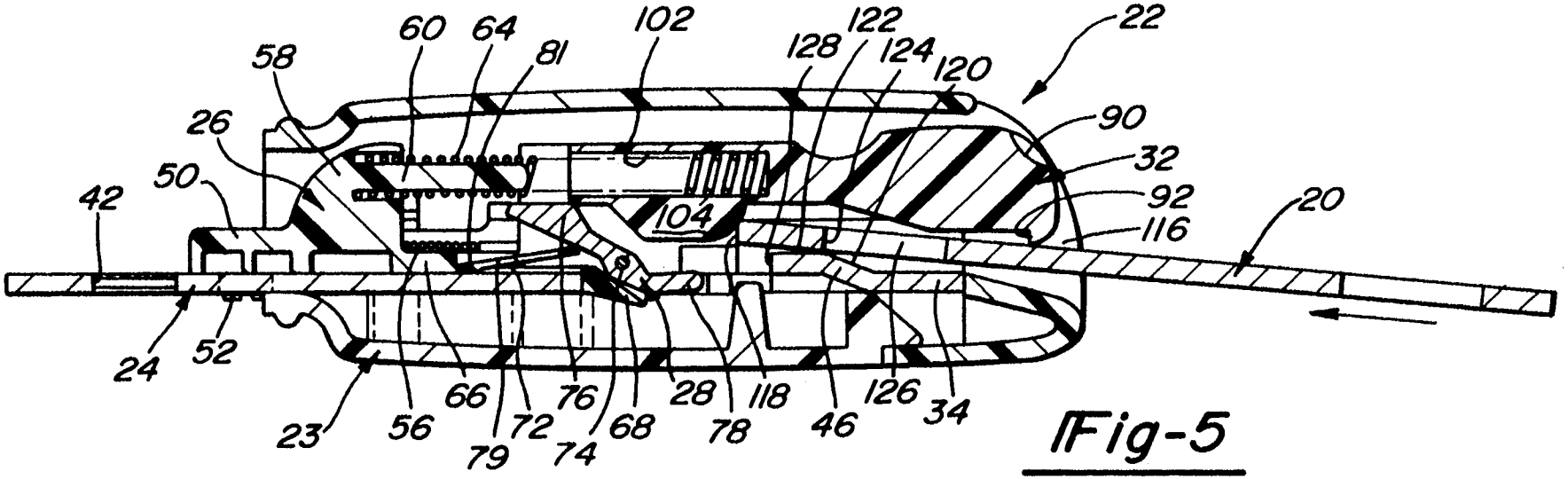
Figure 6:
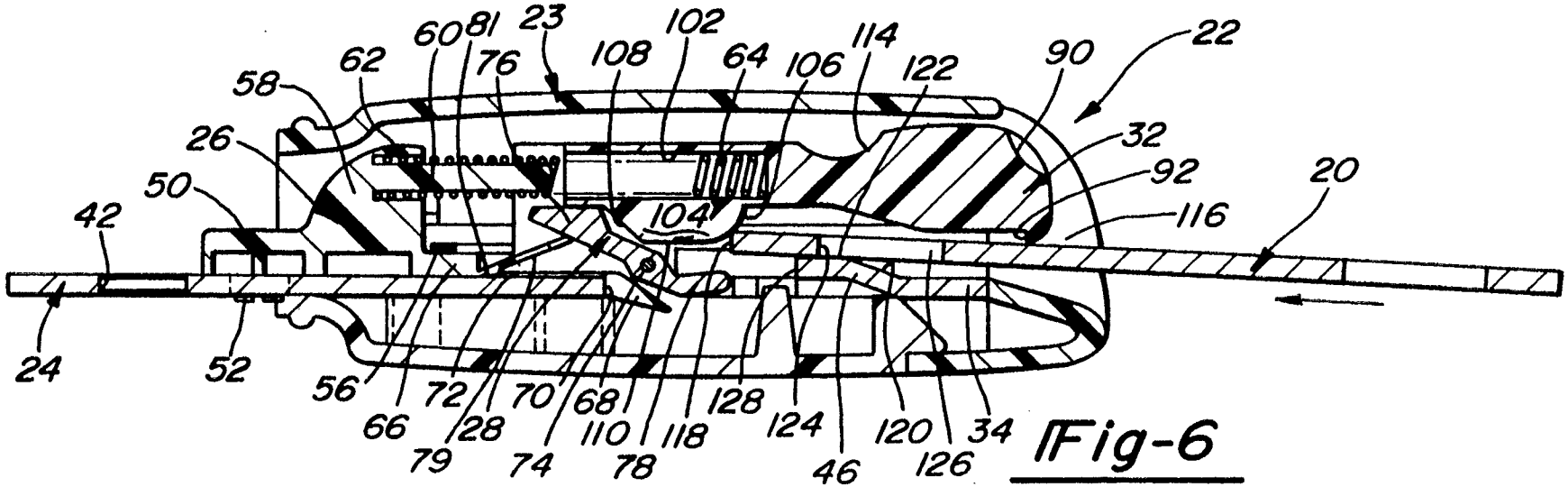

With particular reference now to FIGS. 4 through 11, the process by which belt buckle 22 is releasably latched to tongue plate 20 is sequentially depicted. As shown in FIG. 4, tongue plate 20 is inserted within an entry slot 116 defined vertically by front edge stop 92 of actuator member 32 and plate segment 34 of base 24, and defined laterally by flange segments 36 (FIG. 2) of base 24. As a leading edge 118 of tongue plate 20 is inserted into slot 116, it initially contacts ejector arms 30 for forcibly urging ejector arms 30 rearwardly in opposition to the biasing of ejector springs 56. Latch portion 46 is integral with plate segment 34 and defines a upwardly extending ramp surface 120 which tends to force tongue plate 20 to be slightly angularly displaced during insertion into entry slot 116, as depicted in FIG. 5. Upon continued insertion, leading edge 118 rides over a planar end surface 122 of latch portion 46 and eventually contacts first cam surface 106 of retainer block 104 for forcibly urging actuator member 32 to move rearwardly in opposition to the biasing force exerted thereon by return spring 64. As seen from FIGS. 6 and 7, continued engagement of leading edge 118 with first cam surface 106 causes continued rearward movement of actuator member 32 until leading edge 118 eventually contacts lifter portion 78 of rocker arm 28, thereby forcibly pivoting rocker arm 28 in a first direction (i.e., clockwise in the drawings) about pivot 74. Alternatively, the biasing of rocker arm 28 due to engagement of cantilevered beam 79 with plate segment 34 of base 24 may be sufficient to permit leading edge 118 to slide over lifter portion 78 of rocker arm 28.

Figure 7:
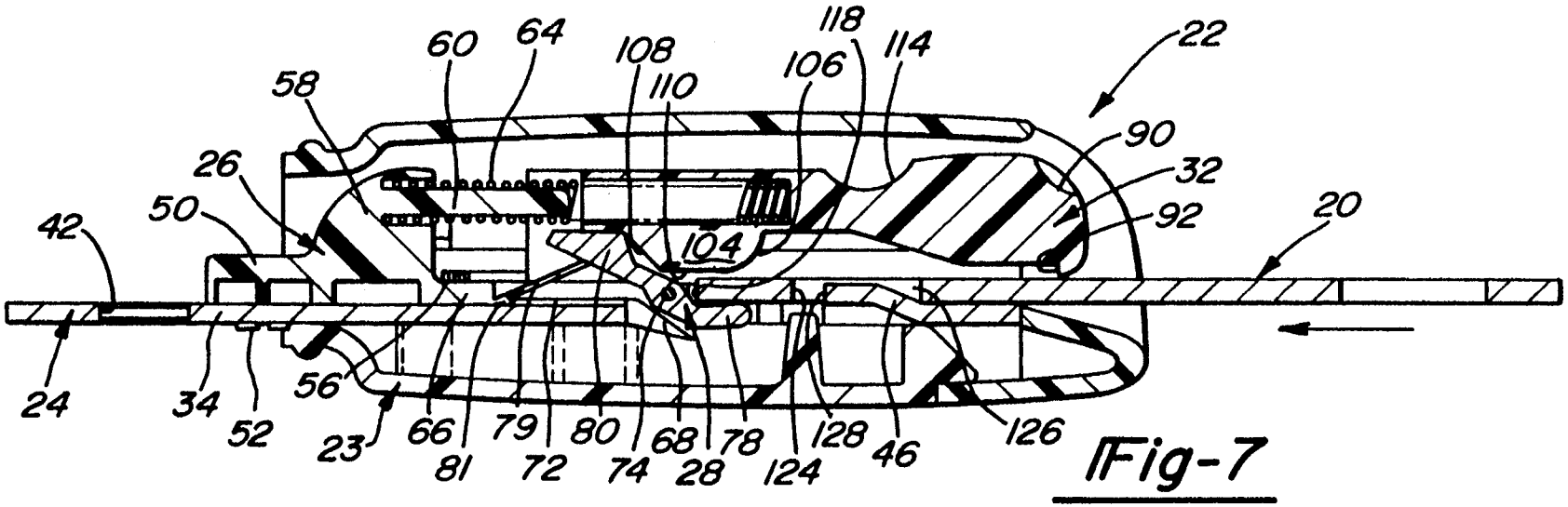

With reference to FIG. 7, as a front edge 124 of a latch aperture 126 formed in tongue plate 20 crosses the threshold defined by a rear locking edge 128 of latch portion 46, leading edge 118 of tongue plate 20 slides off first cam surface 106 of actuator member 32 such that latch aperture 126 is urged downwardly for surrounding latch portion 46, thereby establishing a "latched" position. Such action is due to the cam profile of first cam surface 106 and the biasing exerted thereon by return spring 64. As can be seen, once leading edge 118 disengages first cam surface 106, return spring 64 immediately biases actuator member 32 forwardly such that intermediate surface 110 covers leading edge 118. If the seat occupant attempts to continue to insert tongue plate 20 into buckle entry slot 116 beyond the "latched" position, tongue plate 20 reaches an "override" position (FIG. 7) at which point continued insertion is inhibited due to leading edge 118 engaging one of rocker arm 28 or lug 68.

After the insertion force imposed by the seat occupant on tongue plate 20 is released, return spring 64 urges actuator member 32 to move forwardly to its forward limit position such that intermediate surface 110 of retainer block 104 is still positioned over leading edge 118 of tongue plate 20. Concurrently, ejector springs 56 urge ejector arms 30, as well as tongue plate 20, to move forwardly until front edge 124 of latch aperture 126 on tongue plate 20 contacts and lockingly engages locking edge 128 of latch portion 46 in a "spring-biased" latched position, shown in FIG. 8. As can be seen, retainer block 104 is operable for retaining tongue plate 20 in the spring-biased latched position shown.

Figure 8:
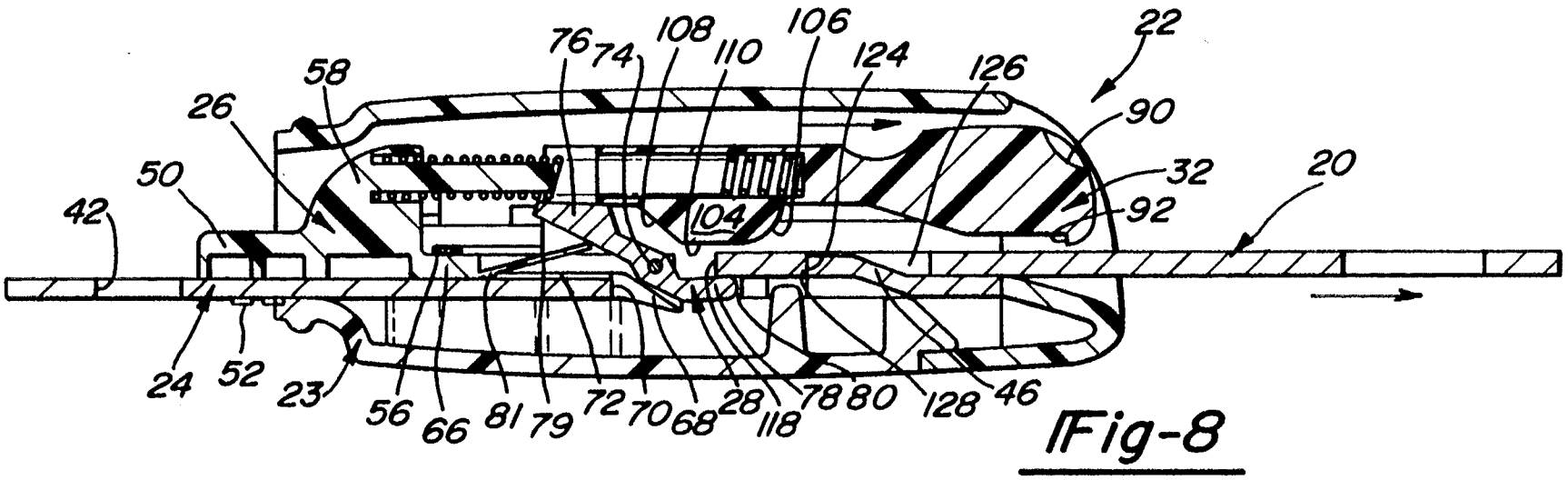
Figure 9:
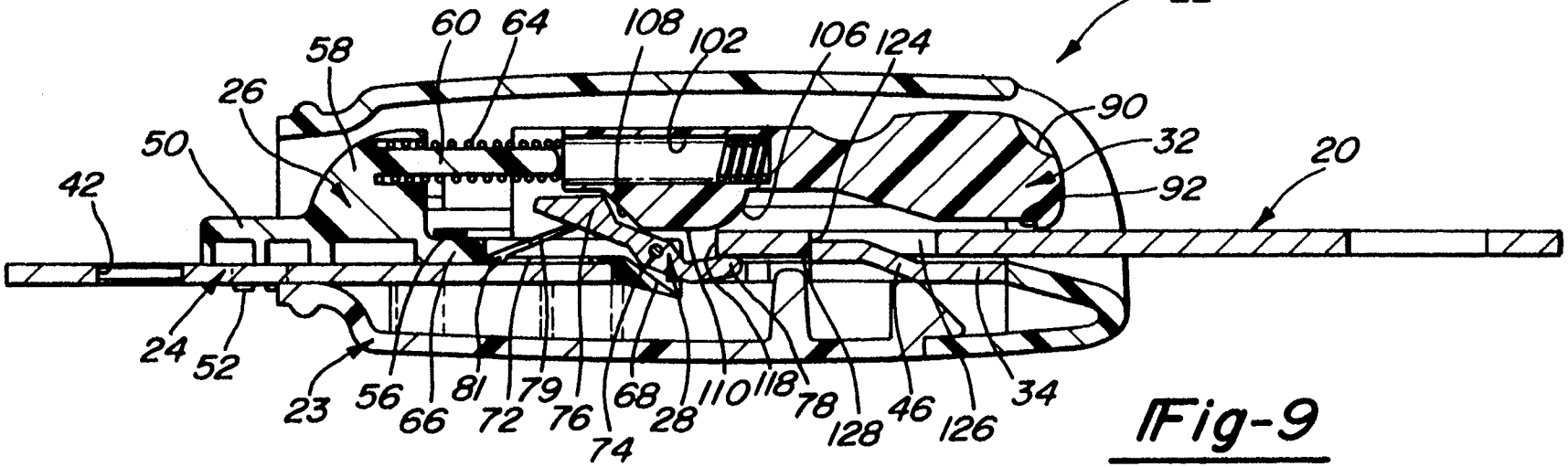
Figure 10:
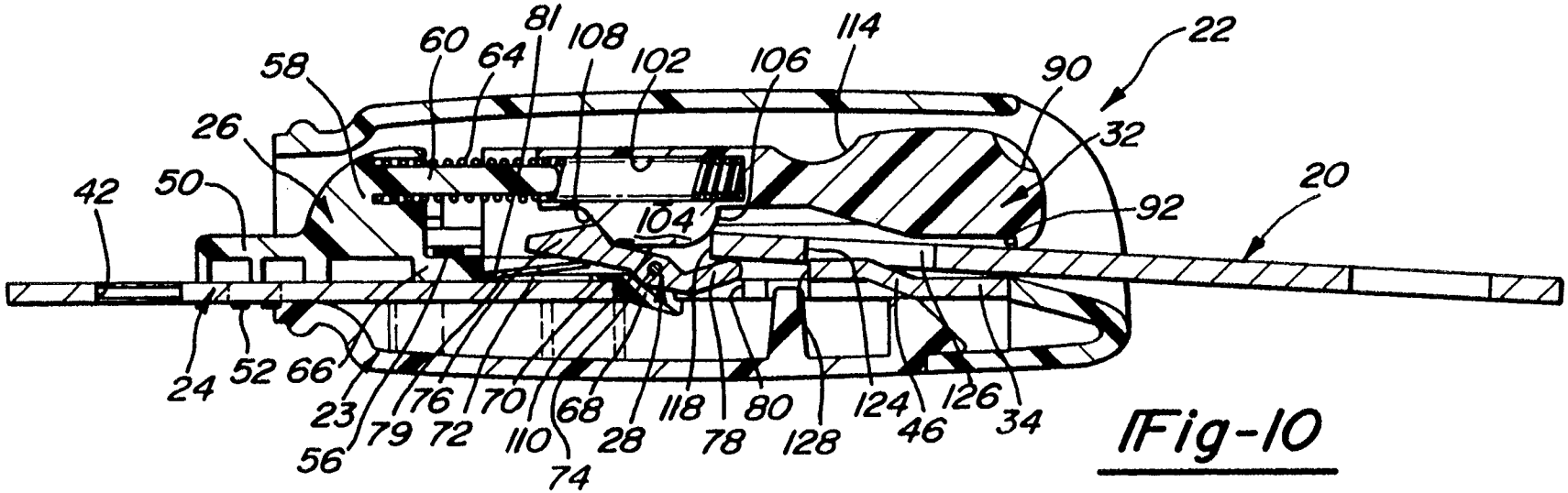
Figure 11:
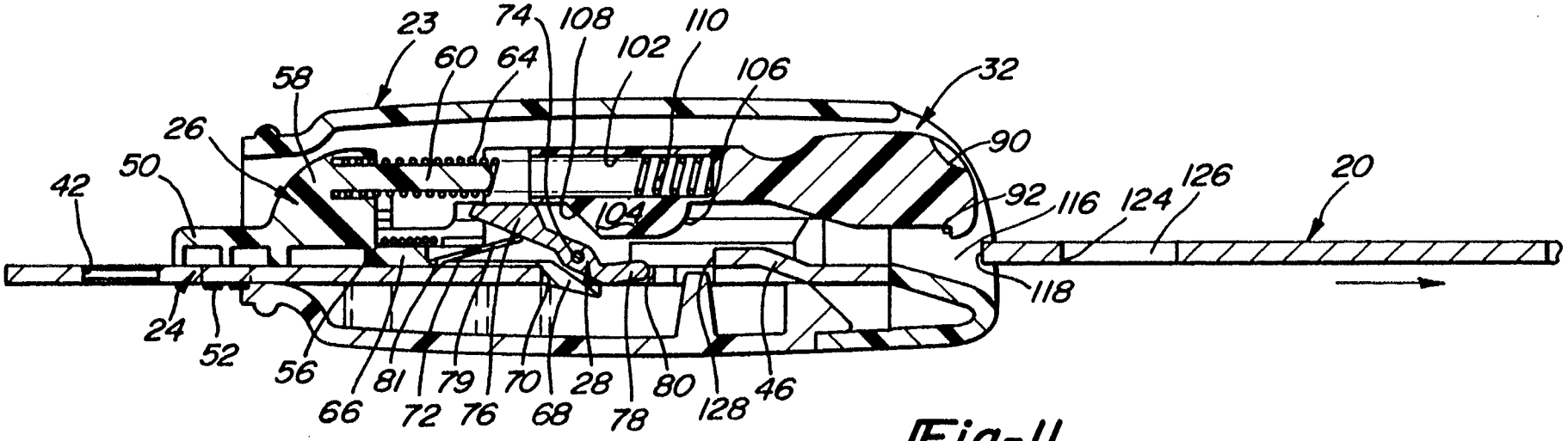

To release tongue plate 20 from end release belt buckle 22, the seat occupant must forcibly slide actuator member 32 inwardly in opposition to the biasing of return spring 64 from the "spring-biased" latched position of FIG. 8 progressively through the intermediate position of FIG. 9 to the "released" position of FIG. 10. As seen from FIG. 9, initial movement of actuator member 32 toward the released position causes intermediate surface 110 of retainer block 104 to uncover leading edge 118 of tongue plate 20 and expose it to first cam surface 106. Upon continued inward movement of actuator member 32, second cam surface 108 of retainer block 104 engages lever portion 76 of rocker arm 28 for causing rocker arm 28 to pivot about pivot 74 in a second direction (i.e., counterclockwise in drawings). Such pivotable movement of rocker arm 28 causes lifter portion 78 to forcibly act on the underside surface of tongue plate 20 in close proximity to leading edge 118. As seen from FIG. 10, such action causes leading edge 118 to ride up or cam on first cam surface 106, whereby front edge 124 of latch aperture 126 is released from engagement with locking edge 128 of latch portion 46 for establishing the "released" position. Once tongue plate 20 is angularly displaced to the released position, ejector arms 30 under the biasing influence of ejector springs 56, forcibly urge tongue plate 20 out of entry slot 116, thus assisting in ejection of tongue plate 20 from belt buckle 22. The length of lever portion 76 can be selected for establishing a desired release force exerted on actuator member 32 to release tongue plate 20 when seat belt 14 is under load. Finally, tongue plate 20 is shown in FIG. 11 in a completely ejected or withdrawn position following release of actuator member 32 by the seat occupant. As will be appreciated, upon such complete withdrawal of tongue plate 20, ejector arms 30 and actuator member 32 are biased to return to their forward limit positions (FIGS. 4 and 11 ).

In addition to the above, end release belt buckle 22 is further adapted to include an illumination mechanism for illuminating portions thereof so as to allow the seat occupant to quickly locate belt buckle 22 such that tongue plate 20 can be readily latched or released therefrom. Accordingly, FIGS. 12 through 17 illustrate three alternative preferred embodiments for the incorporation of an illumination mechanism into buckle member 22 which are each an improvement over conventional belt buckle illumination arrangements. For the purpose of clarity, like numbers are used hereinafter to identify those components that are identical or substantially similar in function to components disclosed relative to the end release belt buckle shown in FIGS. 1 through 11. In general, each embodiment includes an illuminating device 200 disposed within a chamber or cavity 202 formed in actuator member 32 and which is connected to a suitable remote electrical power source by a unique electrically conductive connector arrangement for illuminating selected portions of light emitting actuator member 32. While not critical to the structure of the various illuminated belt buckle embodiments of the present invention, the remote electrical power source could be adapted to supply a predetermined line current when the vehicle's headlamps are turned on. Illuminating device 200 is preferably a light emitting diode or "LED", however, one of ordinary skill in the art would recognize that any number of illuminating bulbs or the like could likewise be used.

Figure 12:
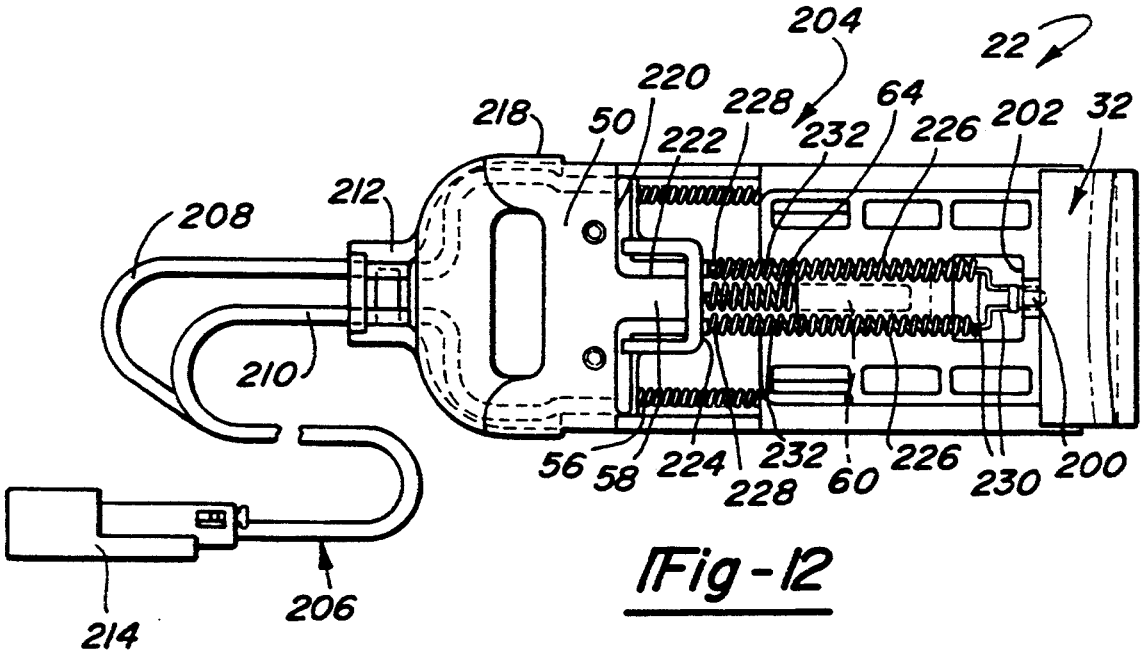
FIG. 12 is a top view of an alternative embodiment of the end release buckle of the present invention, with its protective housing deleted for clarity, illustrating the use of coil springs for conducting an electrical current to an illumination device disposed within the actuator member.
Figure 13:
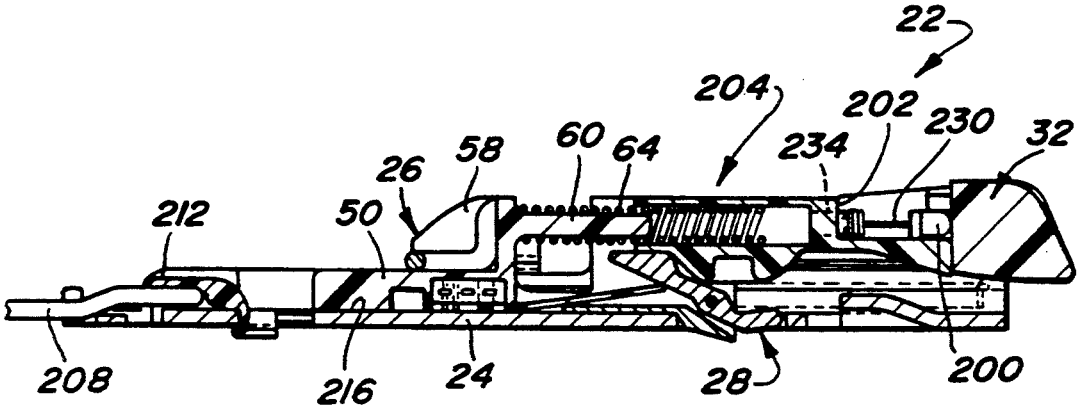
FIG. 13 is a sectional view of the illuminated end release buckle shown in FIG. 12.

With particular reference to FIGS. 12 and 13, an illumination mechanism 204 includes an electrical harness assembly 206 having wires 208 and 210 that are routed through a retaining clip 212 fixed to one end of belt buckle member 22. Electrical harness assembly 206 further includes a plug-in connector 21 4 of otherwise conventional construction that is adapted for interconnection with any suitable electrical power source (not shown) located remotely from belt buckle 22. Moreover, wires 208 and 210 are routed to pass through and be secured to retaining clip 212, to extend forwardly along an upper surface 216 and adjacent to an outer peripheral edge 218 of base 24, and then to extend upwardly and laterally along a forward edge 220 of lateral support segment 50 of support block 26. As best seen in FIG. 12, wires 208 and 210 converge toward one another along forward edge 220 until they are adjacent to raised backstop segment 58. Furthermore, the distal ends of wires 208 and 210 extend forwardly along lateral edges 222 of raised backstop segment 58 and terminate adjacent to a forward face 224 thereof.

In the particular embodiment disclosed in FIG. 12 and 13, illumination mechanism 204 further includes means for maintaining an electrically conductive connection between wires 208 and 21 0 to illuminating device 200. More particularly, a pair of electrically conductive coil springs 226 are interconnected between corresponding terminal ends 228 of wires 208 and 21 0 and leads 230 of illumination device 200. To facilitate and maintain the positioning and alignment of coil springs 226 within belt buckle 22, a pair of spring posts 232 are provided which extend forwardly from forward face 224 of raised backstop segment 58 so as to be aligned in general parallelism with central spring post 60. More particularly, one end of each coil spring 226 is slid over a spring post 232 while the opposite end thereof is retained within a bore 234 formed in actuator member 32. Coil springs 226 extend through bores 234 and into chamber 202 which, as noted, has illumination device 200 at least partially disposed therein. More particularly, a first end of each coil spring 226 is in electrical contact with one terminal end 228 of wires 208 and 21 0. The opposite or second end of each coil spring 226 is in electrical contact with one lead 230 of illumination device 200. Accordingly, when a potential is applied across wires 208 and 210, current passes through one of the wires and its respective coil spring 226, through the lead 230 in contact with the second end of such coil spring, and into illumination device 200 prior to returning through the opposite lead, coil spring and wire.

Figure 14:
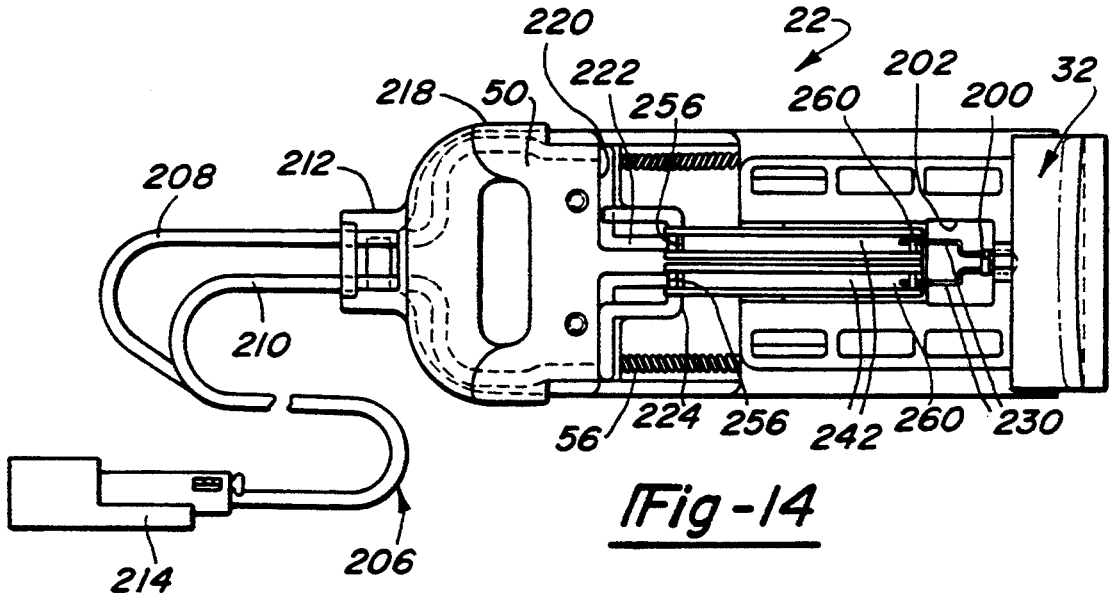
FIG. 14 is a top view of another embodiment of an illuminated end release belt buckle of the present invention, with its protective housing deleted, illustrating the use of flexible strips for conducting an electrical current to the illumination device disposed within the actuator member.
Figure 15:
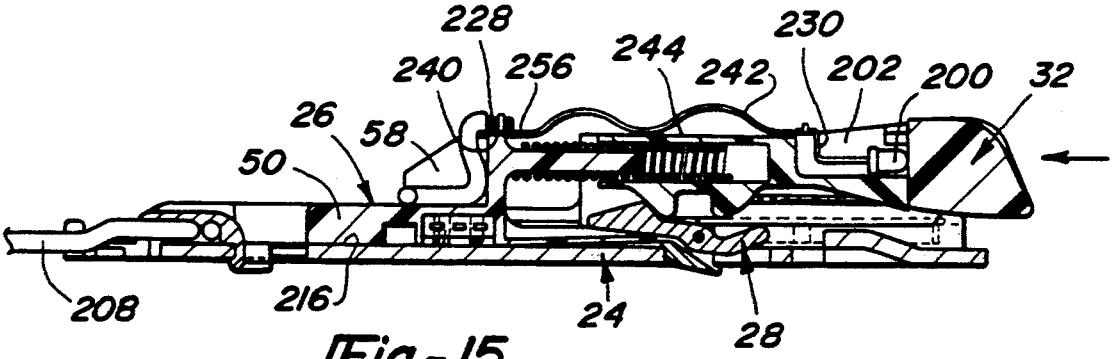
FIG. 15 is a sectional view of the illuminated end release buckle shown in FIG. 14.

FIGS. 14 and 15 illustrate an alternative preferred embodiment of the means for maintaining an electrically conduction between harness assembly 206 and illumination device 200. More particularly, a pair of flexible electrically conductive strips 242 are interconnected between terminal ends 228 of wires 208 and 21 0 and leads 230 of illumination device 200. Thus, when a potential is applied across wires 208 and 210, an electrical current passes through one of the wires and its corresponding flexible strip 242, through the lead 230 extending from illumination device 200 interconnected therewith and into illumination device 200 before returning through the other lead, flexible strip and wire. Note that in this particular embodiment, leads 230 extend rearwardly and upwardly from illumination device 200 so as to terminate adjacent an upper surface 244 of actuator member 32. Thus, flexible strips 242 are generally isolated from actuator member 32 so as not to interfere with the sliding movement of actuator member 32 relative to either base 24 or support block 26. In addition, in an effort to minimize any potential interference, flexible strips 242 are housed within a gap 246 (FIG. 4) created between protective housing 23 and upper surface 244 of actuator member 32 and support block 26.

Figure 17:
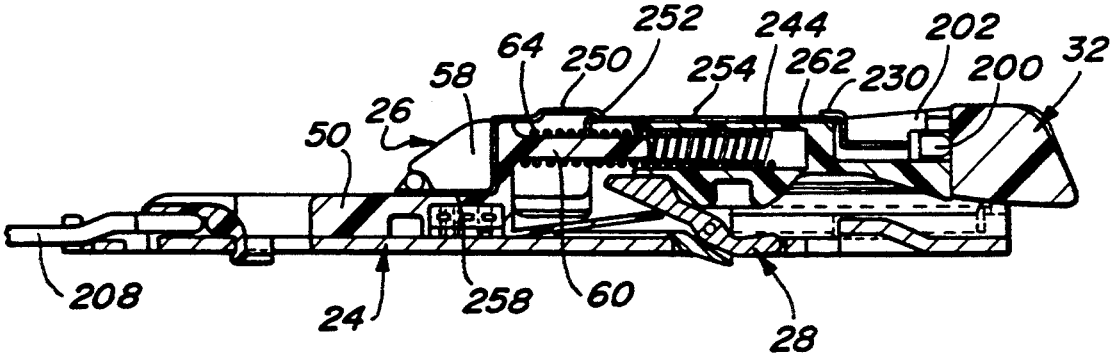
FIG. 17 is a sectional view of the illuminated end release buckle shown in FIG. 16.
Figure 16:
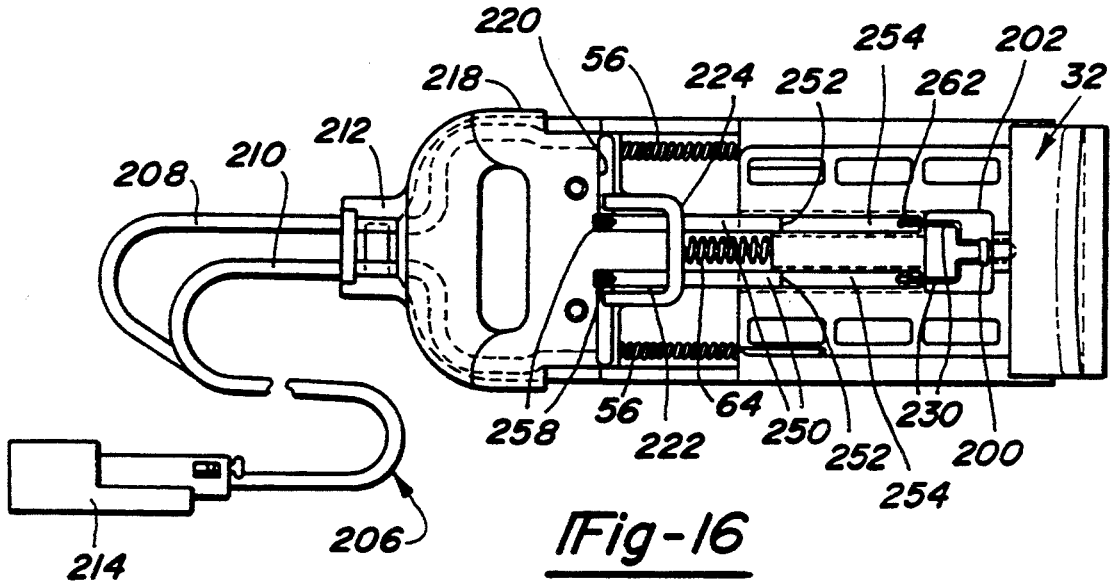
FIG. 16 is a top view of yet another embodiment of an illuminated end release belt buckle of the present invention, again with its protective housing deleted for clarity, illustrating the use of sliding contact strips for conducting an electrical current to the illumination device disposed within the actuator member.

FIGS. 16 and 17 illustrate yet another embodiment of the means electrically conductive connector means that is utilized to make and maintain electrical contact between wires 208 and 210 of harness 206 and illumination device 200. In this embodiment, wires 208 and 21 0 are routed into buckle 22 in the same manner as the previous two embodiments and terminate at lateral edges 222 of raised backstop member 58. A pair of laterally-spaced wiper members 250, in electrical contact with terminal ends 228 of wires 208 and 21 0, are cantilevered to extend forwardly from an upper edge 240 of forward face 222 on raised backstop member 58. Moreover, a distal tip 252 of each wiper member 250 slidingly engages a conductive strip 254 that extends along upper surface 244 of actuator member 32 and which is aligned to be generally parallel to wiper members 250. Each conductive strip 254 is suitably connected to a lead 230 of illumination device 200. In addition, wiper members 250 are biased downwardly such that distal tip 252 of each wiper member 250 is adapted to maintain sliding contact with its respective conductive strip 254. Thus, as with the other embodiments, when a potential is applied across wires 208 and 21 0, current is conducted through one of the wires, one of the cantilevered wiper members 250 and the conductive strip 254 in contact therewith, through the corresponding one of leads 230 and into illumination device 200 before returning through the other lead, conductive strip, cantilevered wiper and wire.

The primary purpose of each of the above-described electric circuits is to maintain electrical contact between wires 208 and 21 0 and illumination device 200 as actuator member 32 is depressed and released. As shown in FIGS. 12 and 13, the utilization of a pair of coil springs 226 that extend between wires 208 and 21 0 and leads 230 readily permits actuator member 32 to be depressed and released without causing a break in the electrical circuit. When actuator member 32 is depressed, coil springs 226 are compressed upon spring posts 232. When actuator member 32 is released, coil springs 226 assist in returning actuator member 32 to its forward limit position.

As best shown in FIG. 15, the second electrical circuit utilizes flexible conductive strips 242 to maintain contact between wires 208 and 21 0 and leads 230 as actuator member 32 is depressed and released. When actuator member 32 is depressed, flexible conductive strips 242 simply flex, thereby permitting actuator member 32 to be fully depressed without resistance and without breaking electrical contact between wires 208 and 210 and leads 230. When actuator member 32 is released, it is spring-biased to its forward limit position by return spring 64 and flexible conductive strips 242 are permitted to relax.

As best shown in FIG. 17, the third electrical circuit utilizes a sliding-type contact to maintain electrical contact between wires 208 and 210 and leads 230. When actuator member 32 is depressed, distal tips 252 of cantilevered wiper members 250 slidingly engage conductive strips 254 as these conductive strips 254 move rearwardly with actuator member 32. When actuator member 32 is released, return spring 64 urges it forwardly to its forward limit position and conductive strips 254 move forwardly therewith, all the while in electrical contact with distal tips 252 of cantilevered wiper members 250. Consequently, all three electrical circuit embodiments are capable of maintaining electrical contact between wires 208 and 210 and leads 230 as actuator member 32 is depressed and released. Thus, illumination device 200 can be either affixed to or disposed directly within actuator member 32, thereby allowing selected portions of actuator member 32 to be continuously illuminated from within.

If coil springs 226 are used in the electric circuit, each coil spring 226 is placed over a spring post 232 and the first end is soldered to a terminal end 228 of one of wires 208 and 210 before both springs 226 and spring posts 232 are inserted into corresponding bores 234. Thereafter, the second end of each coil spring 226 is soldered to one of leads 230 extending from illumination device 200. If, on the other hand, either flexible strips 242 or sliding wiper contacts 250 are utilized, a rearward end 256 of flexible strip 242 or a rearward end 258 of cantilevered wiper member 250, respectively, are soldered to terminal ends 228 of wires 208 and 21 0 and may further be affixed to the upper edge 240 of raised backstop member 58 if desired. Illumination device 200 is inserted into cavity 202 defined within actuator member 32 and, if desired, is affixed thereto by a suitable adhesive, a fastener or the like. Depending on the particular electrical circuit utilized, leads 230 which extend from illumination device 200 are soldered to the second ends of either coil springs 226, or the forward ends 260 and 262 of flexible strips 242 or conductive strips 254, respectively. Note that electrically conductive strips 254 are affixed to upper surface 244 of actuator member 32 and that coil springs 226 and flexible strips 242 may also be affixed at their forward ends to actuator member 32. Thereafter, housing assembly 23, shown to include otherwise conventional upper and lower housing sections, is secured in a known manner to surround the above-noted illumination and electrical circuit components. Finally, belt buckle 22 is anchored to the vehicle structure by a fastener (not shown) which is disposed within anchor mounting aperture 42.

The present invention thus provides an improved "end release" belt buckle 22 which is relatively simple in structure and easily manufactured and assembled. Moreover, belt buckle 22 of the present invention provides a fixed latch portion 46 which may be integrally formed with base 24, rather than use of a conventional movable locking pawl which is inherently less reliable. Moreover, the present invention provides a single arrangement for forcibly urging tongue plate 20 into a latched position, retaining tongue plate 20 in the latched position, and actuating a release mechanism for urging the tongue plate out of the latched position when release of tongue plate 20 is desired. Finally, various improved electrical circuits are disclosed for incorporating an illumination device into belt buckle 22.

It should be understood that an unlimited number of configurations of the present invention can be realized. The foregoing discussion discloses and describes a merely exemplary embodiment of the present invention. One skilled in the art will readily recognize from the discussion and from the accompanying drawings and claims that various changes and modifications can be made without departing from the spirit and scope of the invention, as defined in the following claims.

What is claimed is:

1. An illuminated end release buckle for a vehicular safety belt restraint system, comprising:

a base having a latch portion for releasably locking a tongue plate retained on a vehicular safety belt such that said tongue plate is maintained in a held relationship with respect to said base when operatively engaged therewith;

an actuator supported for movement on said base for selectively disengaging said tongue plate from said latch portion of said base such that said tongue plate can be selectively released from said held relationship;

an illumination mechanism at least partially disposed with said actuator for illuminating portions thereof; and an electrical circuit having a pair of wires secured to said base and a pair of electrically conductive coupling members extending between, and in electrical contact with, said wires and said illumination mechanism, said coupling members permitting said actuator to slide with respect to said base while maintaining continuous electrical contact between said wires and said illumination mechanism.

2. The illuminated end release buckle of claim 1 wherein said electrically conductive coupling members are a pair of coil springs which compress and relax as said actuator is slid with respect to said base.

3. The illuminated end release buckle of claim 1 wherein said electrically conductive coupling members are a pair of flexible strips which flex and relax as said actuator is slid with respect to said base.

4. The illuminated end release buckle of claim 1 where said electrically conductive coupling members are a pair of sliding contact strips, each of said contact strips comprising a cantilevered wiper member that slidingly engages a strip affixed to said actuator such that as said actuator is slid with respect to said base, said cantilevered wiper member slides along and maintains contact with said strip.

5. The illuminated end release buckle of claim 1 wherein said illumination mechanism is a light emitting diode.

6. An electrical circuit for providing electrical current to a device retained on a sliding actuator member of a safety belt buckle, said electrical circuit comprising:

a pair of current conducting members at least partially disposed within said buckle, each of said current conducting members having a terminal end; and a pair of electrically conductive coupling members interconnecting said terminal ends of said current conducting members to said device such that said conductive coupling members span a gap defined between said buckle and said actuator member, said conductive coupling member being adapted to permit said actuator member to slide with respect to said buckle while maintaining electrical contact between said current conducting members and said device.

7. The electrical circuit of claim 6 wherein said conductive coupling members are a pair of coil springs which compress and relax as said actuator member is slid with respect to said buckle.

8. The electrical circuit of claim 7 wherein one end of each of said coil springs surrounds spring post that extends from said buckle and another end of each of said coil springs passes through a counterbore formed in said actuator member such that said spring flexes and relaxes along a single axis.

9. The electrical circuit of claim 6 wherein said conductive coupling members are a pair of flexible strips which flex and relax as said actuator member is slid with respect to said buckle.

10. The electrical circuit of claim 6 wherein said conductive coupling members are a pair of sliding contact strips, each of said contact strips comprising a cantilevered wiper member that extends from said buckle and slidingly engages a strip affixed to said actuator member such that as said actuator member is slid with respect to said buckle, said cantilevered wiper member slides along and maintains contact with said strip.

11. An illuminated belt buckle for a vehicular safety belt restraint system comprising:

a base having a latch portion for releasably locking a tongue plate retained on a vehicular safety belt such that tongue plate is maintained in a held relationship with respect to said base when operatively engaged therewith;

an actuator supported for movement on said base for selectively disengaging said tongue plate from said latch portion of said base such that said tongue plate can be selectively released from said held relationship;

an illumination mechanism affixed to said actuator for longitudinal movement therewith;

an electrical current source including a harness assembly having a pair of wires connected to a remote line current; and a pair of electrically conductive coil springs extending between, and in electrical contact with, said wires and said illumination mechanism for maintaining an electrical connection therebetween during movement of said actuator for illuminating portions of said actuator.

12. An illuminated belt buckle for a vehicular safety belt restraint system comprising:

a base having a latch portion for releasably locking a tongue plate retained on a vehicular safety belt such that tongue plate is maintained in a held relationship with respect to said base when operatively engaged therewith;

an actuator supported for movement on said base for selectively disengaging said tongue plate from said latch portion of said base such that said tongue plate can be selectively released from said held relationship;

an illumination mechanism affixed to said actuator for longitudinal movement therewith;

an electrical current source including a harness assembly having a pair of wires connected to a remote line current; and a pair of electrically conductive flexible strips extending between, and in electrical contact with, said wires and said illumination mechanism for maintaining an electrical connection therebetween during movement of said actuator for illuminating portions of said actuator.

13. An illuminated belt buckle for a vehicular safety belt restraint system comprising:

a base having a latched portion for releasably locking a tongue plate retained on a vehicular safety belt such that said tongue plate is maintained in a held relationship with respect to said base when operatively engaged therewith;

an actuator supported for movement on said base for selectively disengaging said tongue plate from said latch portion of said base such that said tongue plate can be selectively released from said held relationship;

an illumination mechanism affixed to said actuator;

an electrical current source including a harness assembly having a pair of wires connected to a remote current line; and a pair of sliding electrically conductive contact strips, each of said contact strips including a cantilevered wiper member that slidingly engages a strip affixed to said actuator such that as said actuator is slid with respect to said base said cantilevered wiper member slides along and maintains electrical contact with said strip for illuminating portion of said actuator.

* * * * *